US009849692B2

(12) United States Patent
Buenting et al.

(10) Patent No.: US 9,849,692 B2
(45) Date of Patent: Dec. 26, 2017

(54) METHOD AND APPARATUS FOR TRANSFERRING A PRINTING SUBSTANCE ONTO A SUBSTRATE BY MEANS OF LASER RADIATION

(71) Applicant: LPKF Laser & Electronics AG, Garbsen (DE)

(72) Inventors: Udo Buenting, Suthfeld (DE); Bostjan Podobnik, Ljubljana (SI); Rok Petkovsek, Ljubljana (SI); Roman Ostholt, Langenhagen (DE)

(73) Assignee: LPKF LASER & ELECTRONICS AG, Garbsen (DE)

( * ) Notice: Subject to any disclaimer, the term of this patent is extended or adjusted under 35 U.S.C. 154(b) by 0 days.

(21) Appl. No.: 15/441,267

(22) Filed: Feb. 24, 2017

(65) Prior Publication Data

US 2017/0246882 A1 Aug. 31, 2017

(30) Foreign Application Priority Data

Feb. 26, 2016 (EP) ..... 16401014

(51) Int. Cl.
*B41J 2/44* (2006.01)
*B41J 2/47* (2006.01)
(Continued)

(52) U.S. Cl.
CPC ..... *B41J 2/455* (2013.01)

(58) Field of Classification Search
CPC ..... B41M 5/24; B41M 2205/08; B41J 2/435; B41J 2/44; B41J 2/442; B41J 2/455;
(Continued)

(56) References Cited

U.S. PATENT DOCUMENTS 5,017,944 A * 5/1991 Kitamura ..... H04N 1/40037 347/247
5,171,650 A * 12/1992 Ellis ..... B41M 3/14 430/20
(Continued)

FOREIGN PATENT DOCUMENTS

DE 19746174 C1 7/1999
DE 19829684 B4 7/2005
(Continued)

*Primary Examiner* — Huan Tran
*Assistant Examiner* — Alexander D Shenderov
(74) *Attorney, Agent, or Firm* — Leydig, Voit & Mayer, Ltd.

(57) ABSTRACT

A method for transferring a printing substance provided as a coating on a carrier onto a substrate by laser radiation from a laser beam source that comprises an amplifier and that has an output power includes initiating a transfer process at the start of an active phase during a first time period by a temporary increase in the output power above an upper power threshold of the laser radiation, and adjusting the output power during a second time period of the active phase following the first time period, wherein the output power is adjusted during the second time period constantly in the range between the upper power threshold and a lower power threshold. The laser radiation and the carrier are moved relative to one another and the output power of the laser beam source is time modulated.

17 Claims, 4 Drawing Sheets

(51) Int. Cl.
*B41J 2/475* (2006.01)
*B41J 2/455* (2006.01)

(58) Field of Classification Search
CPC ... B41J 2/47; B41J 2/475; G05B 2219/49353; H01S 3/10; H01S 3/10015; H01S 3/10038; H01S 3/06754; H01S 3/094076
USPC ..... 347/247; 359/238, 276, 284, 286, 289
See application file for complete search history.

(56) References Cited

U.S. PATENT DOCUMENTS

| | | | | |
|---|---|---|---|---|
| 6,177,151 | B1 * | 1/2001 | Chrisey | C23C 14/048 219/121.85 |
| 8,247,320 | B2 * | 8/2012 | Lochtman | H01L 31/02242 257/E21.477 |
| 2003/0071020 | A1 | 4/2003 | Hong et al. | |
| 2011/0085149 | A1 | 4/2011 | Nathan | |
| 2011/0097550 | A1 | 4/2011 | Matusovsky et al. | |

FOREIGN PATENT DOCUMENTS

| | | | |
|---|---|---|---|
| GB | 2173452 | A | 10/1986 |
| WO | WO 2002092674 | A1 | 11/2002 |

* cited by examiner

METHOD AND APPARATUS FOR TRANSFERRING A PRINTING SUBSTANCE ONTO A SUBSTRATE BY MEANS OF LASER RADIATION

CROSS REFERENCE TO RELATED APPLICATIONS

This application claims benefit to European Patent Application No. EP 16 401 014.2, filed Feb. 26, 2016, which is incorporated by reference herein.

FIELD

The invention relates to a method and to an apparatus for transferring a printing substance onto a substrate by laser radiation from a laser beam source that comprises an amplifier.

BACKGROUND

Printing methods for transferring a printing substance onto a substrate by laser radiation are used, for example, for digitally printing printing inks or pastes. In what are known as laser transfer printing methods, the laser radiation from a laser arrangement is directed through a transparent carrier of a print medium, for example a paste contained in a capsule or an ink. The content of the capsule is transferred onto a substrate by means of the energy input.

For this purpose, the laser radiation is moved over the carrier by an optical device. At the same time, the output power of the laser beam source is time modulated such that printing substance is transferred only during an active phase and no printing substance is transferred during a passive phase.

The basic principle of a method of this type is known from WO 2002/092674 A1. In this case, a substrate faces a carrier that is transparent for the laser radiation and is coated. If this layer is irradiated with laser radiation through the carrier, some of the material of the layer is evaporated. This causes the unevaporated portion to be transferred onto the substrate.

DE 197 46 174 C1 discloses a method in which the printing substance is applied to a cylindrical, transparent printing forme which has a plurality of cells. The printing substance is transferred from the cells onto a printing material in that a change in volume or position is caused by an energy-releasing device, for example a laser beam source.

GB 2 173 452 A discloses an apparatus and a method for laser printing. In this case, a printing carrier is used, for example made of paper, the surface of which is coated with microcapsules which contain printing ink. A microcapsule of this type is made to burst by laser radiation impinging on said capsule. The printed image is formed for example by linear scanning, whereby the corresponding image points are produced by activation by means of laser radiation. For some image points, the laser is active while for others the emission is interrupted, depending on whether or not printing ink is intended to be transferred at the particular image point.

In contrast, an undesired effect also known as spiking, which occurs during the transient phase of a laser, proves to be unhelpful. After the emission of a laser has been interrupted for only a few milliseconds, the first pulse has a highly variable intensity, mostly characterized by a clear increase at the start known as a "spike." In the printing process, this leads to considerably varying results, depending on whether or not the emission of the laser is interrupted.

DE 198 29 684 B4 discloses a laser arrangement in which the radiation from two intensity-controllable laser diodes is coupled into a fiber laser which is pumped from a separate pump source. For modulation, the laser diodes are actuated in phase opposition, i.e. alternately, meaning that the sum of the powers of the laser diodes is constant. The modulation occurs by controlling one of the laser diodes, while the other laser diode is used to keep the total power in the fiber laser constant. During the active phase of the laser arrangement, in which the radiation used is emitted, the first laser diode is active; during the passive phase, in which the output radiation is directed for example into a beam trap and the laser beam source is effectively switched off, the second laser diode is active. By always supplying the fiber amplifier with a constant power and thus keeping it in saturation, the undesired spontaneous emission of the fiber amplifier is completely suppressed and a high level of contrast is achieved.

Inter alia, an improvement of the described laser arrangement can be found in US 2011/0085149. This document describes that, at high power densities of the laser radiation together with a very narrow bandwidth, as is emitted by laser diodes, Brillouin scattering occurs inside a fiber amplifier, which scattering can lead to a destruction of the optical elements. This can be prevented, for example, in that periodic interruptions are imprinted on the control signal of the laser diodes, which interruptions lead to a significantly wider band emission.

SUMMARY

In an embodiment, the present invention provides a method for transferring a printing substance provided as a coating on a carrier onto a substrate by laser radiation from a laser beam source that comprises an amplifier and has an output power, in which the laser radiation and the carrier are moved relative to one another and in the process the output power of the laser beam source is time modulated such that the printing substance is transferred only during an active phase and no printing substance is transferred during a passive phase. The method includes initiating the transfer process at the start of the active phase during a first time period of the transfer of the printing substance by a temporary increase in the output power above an upper power threshold of the laser radiation, and adjusting the output power during a second time period of the active phase following the first time period, wherein the output power is adjusted during the second time period constantly in the range between the upper power threshold and a lower power threshold.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
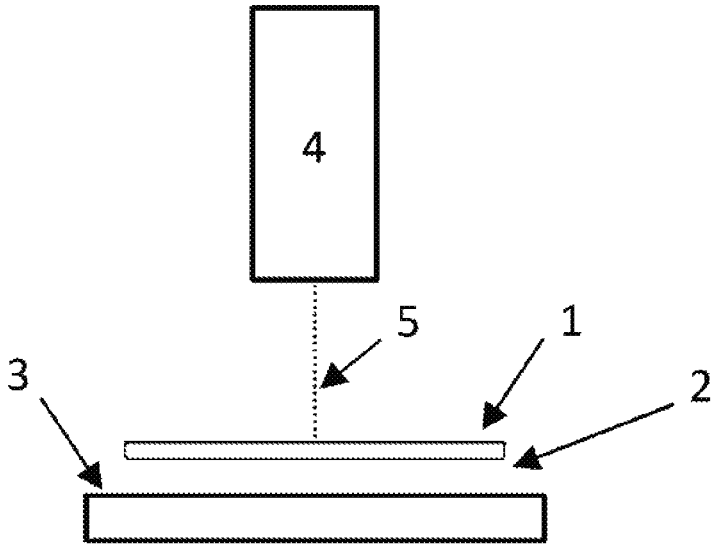
FIG. 1 is a schematic sketch of an apparatus for transferring printing substance from a carrier onto a substrate according to an embodiment of the invention.

In using the laser radiation to transfer a printing substance from a carrier onto a substrate, it is necessary to first initiate this process and subsequently to ensure a constant output power of the laser beam source, in order to maintain the transfer process. In laboratory tests, it has surprisingly been proven that a constant output power of the laser beam source is not optimally suitable for this.

A continually constant output power is either too small to initiate the process, leading to the transfer process not starting immediately at the start of the active phase of the beam source, which worsens the spatial resolution of the transfer process, or the constant output power is sufficiently large to initiate the transfer process immediately at the start of the active phase. However, after the printing process has been initiated, the power is too high, which leads to an inhomogeneous transfer of the printing substance.

Against this background, embodiments of the present invention provide a transfer of printing substance which is both constant over time and enables a high spatial resolution. Furthermore, embodiments of the present invention is to provide an apparatus for carrying out the method.

According to an embodiment of the invention, a method is provided in which the transfer process is initiated at the start of the active phase during a first time period of the transfer of the printing substance by means of a temporary increase in the output power above an upper power threshold of the laser radiation, and in a second time period of the active phase following the first time period, after the temporary increase, the output power is adjusted, in particular constantly, in the range between the upper and a lower power threshold, with the exception of temporary interruptions for suppressing Brillouin scattering.

The printing substance is transferred according to embodiments of the invention from the carrier onto the substrate by means of the laser radiation from a laser beam source, the transfer process being initiated by a temporary increase in the output power of the laser radiation produced by means of an inverted increase in the amplifier of the laser beam source. Immediately after this temporary increase, the output power for the duration of the active phase is kept constant at one level which is lower than the temporary increase.

This desired time curve of the output power of the beam source is made possible when the amplifier of the beam source is supplied with the power of two seed lasers, which emit substantially in phase opposition to one another. The amplified radiation of the first seed laser is used as useful radiation for the transfer process; the amplified radiation of the second seed laser is, for example, directed into a beam trap. This trap is only used to keep the inversion in the amplifier in constant saturation during a passive phase of the beam source. The temporary increase in the output power of the beam source, which is required to initialize the transfer process, is achieved by means of the inverted increase in the amplifier, which occurs after a dark phase. For this purpose, the two seed lasers of the beam source are temporarily switched off before the start of an active phase. As soon as the first seed laser is switched on again at the start of the active phase, the increased inversion in the amplifier is reduced and in the process a significantly higher output power is temporarily emitted. According to embodiments of the invention, the temporary increase, i.e. the amplitude of the output power above the upper power threshold, is thus adjusted by the duration of the dark phase.

Following the temporary increase, the amplifier is also supplied with the constant output power of the first seed laser, as a result of which the inversion in the amplifier again assumes a value that is constant over time. The output power of the laser beam source is thus also constant over time, but at a lower level than during the temporary increase.

The described problem of Brillouin scattering can however be suppressed by periodic interruptions in the actuation of the laser diodes, since the interruptions can be selected to be so short that they have no effect at all on the transfer process due to the inertia of said process.

The optical device, by which the laser beam can be moved over the carrier, can be, for example, a Galvanometer Scanner, a polygon scanner, an electro-optical deflector or an acousto-optic deflector.

The optical device deflects the laser radiation substantially along a line. As a result, the interaction zone, in which the laser radiation interacts with the material of the carrier or of the printing substance, is strip shaped. In this case, the length of the strip-shaped zone is significantly greater than its width in this case.

The laser beam is preferably moved over the carrier with a path velocity of more than 10 m/s.

The carrier and the strip-shaped interaction zone are moved relative to one another so that, by means of the transfer process, two-dimensional patterns can be produced from regions in which printing substance has been transferred and regions in which no printing substance has been transferred.

The carrier is preferably moved orthogonally to the large extension of the strip-shaped interaction zone.

The carrier is coated with the printing substance during the transfer process. In order to allow for a continuous transfer, the printing substance on the carrier must therefore be replaced. For this purpose, for example, a coating unit is used, past which the carrier continuously runs. In order to achieve a high spatial resolution of the transfer process at a high productivity, it is advantageous when the shortest duration of the active phase does not exceed 10 ns, preferably being approximately 1 ns.

Similarly, it is advantageous when the temporary increase in the output power has a duration of significantly less than 1 ns. In order to allow the printing substance to be transferred, the carrier is preferably at least partially transparent for the wavelength of the laser radiation. This makes optimal interaction between the laser radiation and printing substance possible. The transfer process is then initiated by the energy input into the printing substance.

Another embodiment of the invention uses a layer which strongly absorbs the laser wavelength and which is applied to the carrier. The printing substance is then applied to this layer. By exposing the absorbing layer to the laser radiation, said layer is heated. The heat conduction into the printing substance then initiates the transfer process.

The transfer process is generally possible using almost any material. According to the invention however, liquid printing substances having a viscosity of less than 106 Pa·s are preferably used.

Furthermore, according to an embodiment of the invention, an apparatus is provided for transferring a printing substance by means of laser radiation in that a carrier is coated with a printing substance and the transfer is initiated by a time-modulatable laser beam source having active phases, in which laser radiation is emitted, and passive phases, in which no laser radiation is emitted.

The laser radiation is moved over the carrier using an optical device. In order to initiate the transfer process with a slight delay at the start of an active phase, the laser beam source temporarily emits a larger output power at the start of an active phase. Subsequently, the radiation source emits a constant, lower power for the duration of the active phase.

FIG. 1 shows a simple design of the apparatus for carrying out the transfer process according to the invention. A stationary carrier 1 comprises a coating that has a printing substance 2. In order to transfer the printing substance 2 onto a substrate 3, an optical device 4 directs laser radiation 5 from a laser beam source (not shown) onto the carrier 1 that has the printing substance 2. As a result of the thermal energy input, this substance is transferred from the carrier 1 onto the substrate 3 in a selective or spatially resolved manner, for example in a punctiform or linear manner. In addition to the deflection of the laser radiation 5, the carrier 1 and/or the substrate 3 can furthermore also be designed so as to be in particular translationally movable, in order to increase the available working space.

Figure 2:
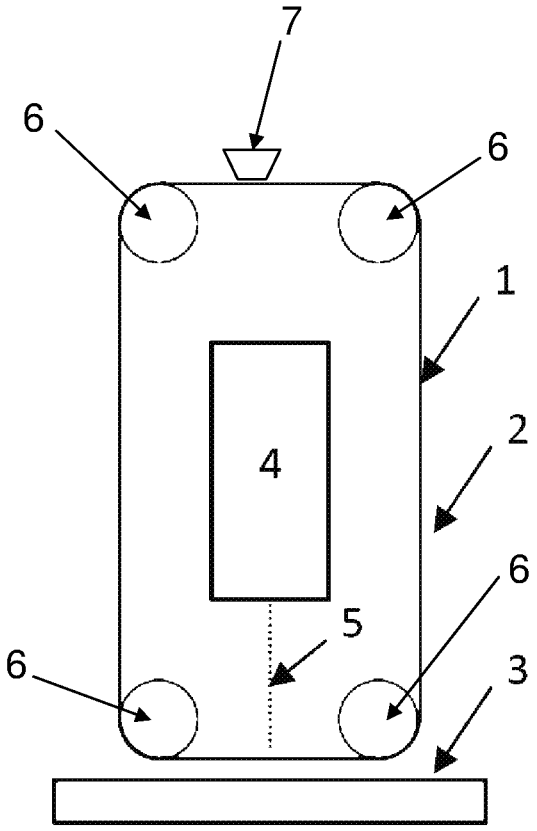
FIG. 2 shows a variant of the apparatus shown in FIG. 1 that has a continuously circulating carrier.

FIG. 2 shows another embodiment of the apparatus. In this case, the carrier 1 is designed as a continuously circulating belt and is guided, in particular continuously, over four guide rollers 6. The entire surface of the carrier 1 is coated with the printing substance 2 on the side thereof which faces the substrate 3. In order to allow for a continuous transfer and in particular to prevent an undesired stoppage in the operation the apparatus, the printing substance 2 on the carrier 1 is replaced in a cyclical or continuous manner. For this purpose, a coating unit 7 is used, past which the carrier 1 continuously runs.

The transfer onto the substrate 3 is again initiated by the thermal energy input of the laser radiation 5, which is directed by the optical device 4 onto the side of the carrier 1 facing away from the coating and thus the printing substance 2 is transferred onto the substrate 3.

Figure 3:
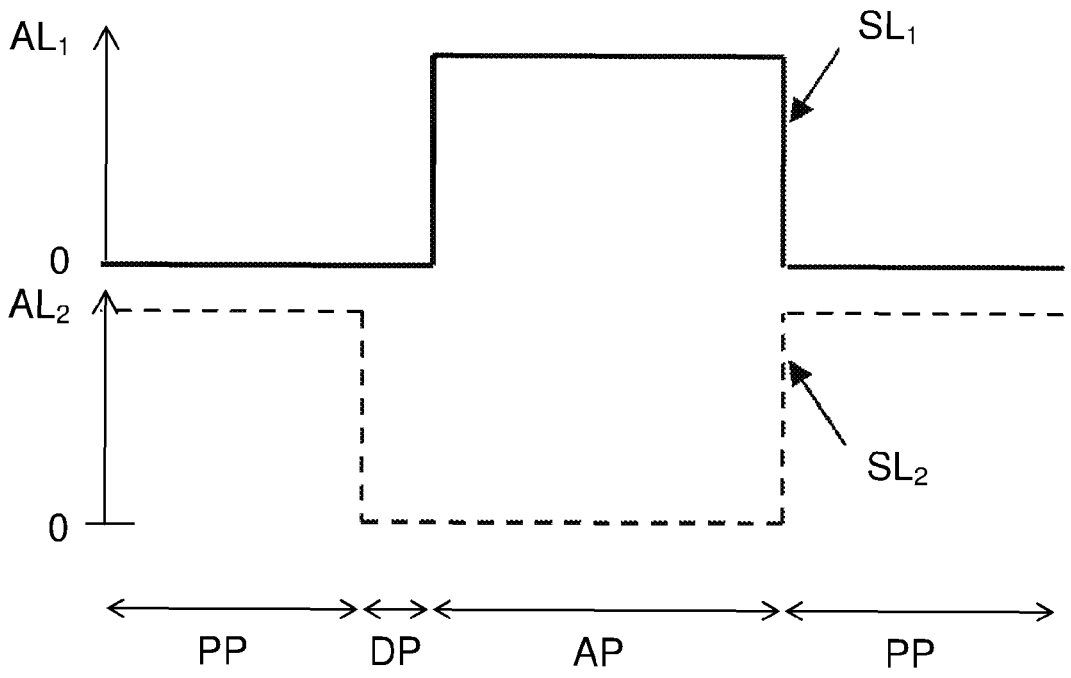
FIG. 3 shows a schematic curve of the particular output power of two seed lasers of the apparatus shown in FIGS. 1 and 2.

FIG. 3 schematically shows the curve of the particular output power of two active seed lasers $SL_1$, $SL_2$ which alternate between an active phase AP and a passive phase PP and which together form the laser beam source (not shown in more detail). By means of the operation, which is substantially in phase opposition, of the two seed lasers $SL_1$, $SL_2$ having an at least substantially corresponding output power $AL_1$ and $AL_2$, respectively, the inversion in an amplifier of the laser radiation source is kept in constant saturation.

Figure 4:
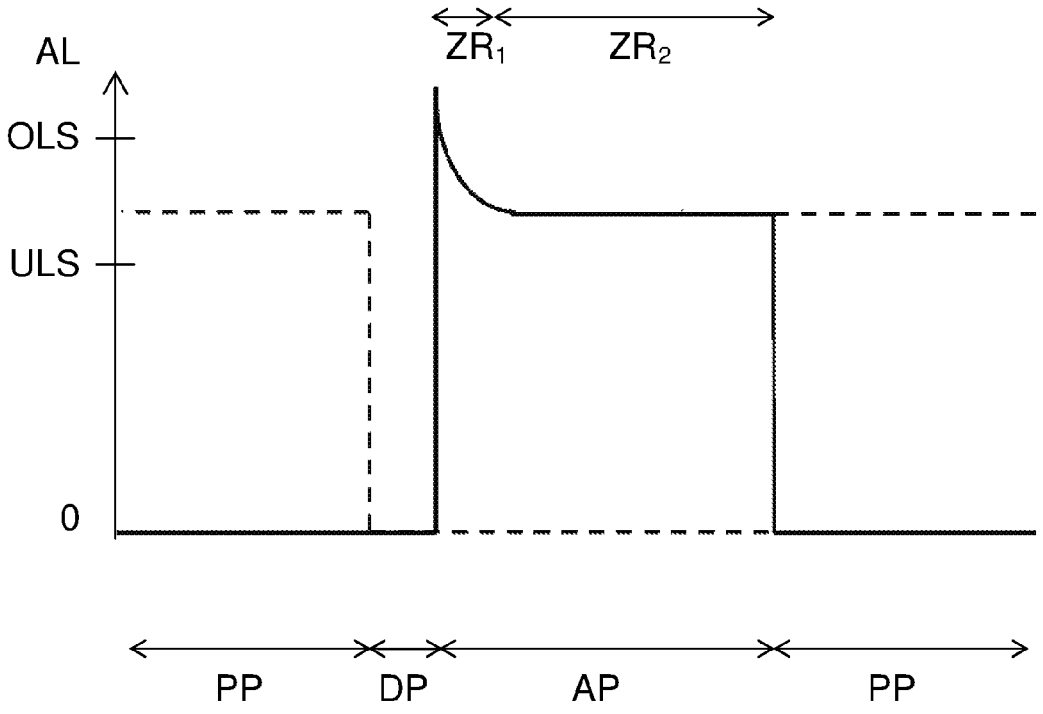
FIG. 4 shows a schematic curve of a resultant total output power of the apparatus from the curve shown in FIG. 3.

Before the start of the active phase AP, the two seed lasers $SL_1$ and $SL_2$ are temporarily switched off, leading to a dark phase DP in which the amplifier is not exposed to any laser radiation. At the start of the active phase AP, the first seed laser $SL_1$ is switched on. The resulting total output power AL of the amplifier of the laser beam source, which, as shown in FIGS. 1 and 2, is directed as laser radiation 5 onto the carrier 1 that has the printing substance 2, is shown in FIG. 4.

The earlier dark phase DP leads, at the start of the active phase AP during a first time period $ZR_1$, to an increase in the total output power AL of the amplifier above an upper power threshold OLS and thus to a transfer of the printing substance 2 right at the start of the active phase AP in contrast with the delay in the transfer that is unavoidable in the prior art.

In the second time period $ZR_2$ of the active phase AP following the first time period $ZR_1$, after the temporary increase in the total output power AL, said output power remains largely constant in the range between the upper power threshold OLS and a lower power threshold ULS. According to the invention, the increase in the power is adjusted by the duration of the dark phase DP.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Carrier
2 Printing Substance
3 Substrate
4 Device
5 Laser Radiation
6 Guide Roller
7 Coating Unit
AP Active Phase
PP Passive Phase
DP Dark Phase
$ZR_1$ First Time Period
$ZR_2$ Second Time Period
$SL_1$ Seed Laser
$SL_2$ Seed Laser
AL Total Output Power
$AL_1$ Output Power
$AL_2$ Output Power
OLS Upper Power Threshold
ULS Lower Power Threshold

The invention claimed is:

1. A method for transferring a printing substance provided as a coating on a carrier onto a substrate by laser radiation from a laser beam source that comprises an amplifier and has an output power, in which the laser radiation and the carrier are moved relative to one another and in the process the output power of the laser beam source is time modulated such that the printing substance is transferred only during an active phase and no printing substance is transferred during a passive phase, the method comprising:

initiating the transfer process at the start of the active phase during a first time period of the transfer of the printing substance by a temporary increase in the output power above an upper power threshold of the laser radiation, and adjusting the output power during a second time period of the active phase following the first time period, wherein the output power is adjusted during the second time period constantly in the range between the upper power threshold and a lower power threshold.

2. The method according to claim 1, wherein either the power of a first seed laser or that of a second seed laser is coupled into the amplifier of the laser beam source, and wherein the increase in the output power during the first time period is produced and adjusted by an earlier dark phase in which no output power is coupled into the amplifier.

3. The method according to claim 1, wherein during the passive phase only the power of one of the two seed lasers is coupled into the amplifier, wherein during a subsequent dark phase neither an output power of the first seed laser nor of the second seed laser is coupled into the amplifier, wherein during the active phase only the power of the other of the two seed lasers is coupled into the amplifier, and wherein the increase in the output power is adjusted during the active phase by the duration of the dark phase.

4. The method according to claim 1, wherein the first time period of the active phase is substantially shorter than the second time period of the active phase.

5. The method according to claim 1, wherein the duration of the first time period is less than 1 ns.

6. The method according to claim 1, wherein the output power is constantly adjusted during the second time period.

7. The method according to claim 1, wherein the output power during the second time period corresponds to from 50% to 80% of the output power during the first time period.

8. The method according to claim 1, wherein the duration of the active phase is less than 10 ns.

9. The method according to claim 1, wherein the output power of the laser beam source is kept constant during the passive phase and the active phase by switching the seed lasers on and off in phase opposition, the emission of which lasers is amplified in a common amplifier.

10. The method according to claim 1, wherein a duration of temporary interruptions for suppressing Brillouin scattering is less than 20 ns.

11. The according to claim 1, wherein the speed of the relative movement of the point at which the laser radiation impinges on the carrier is more than 10 m/s.

12. The method according to claim 1, wherein the carrier is partially transparent for a wavelength of the laser radiation.

13. The method according to claim 1, wherein the carrier is coated with a layer which absorbs the laser wavelength and which converts radiation energy into heat.

14. The method according to claim 1, wherein the carrier is coated with a liquid printing substance that has a viscosity of less than 106 Pa·s.

15. The method according to claim 1, wherein a zone where the laser radiation interacts with the carrier is strip-shaped, and wherein the laser radiation is deflected substantially along a larger extension of the interaction zone.

16. The method according to claim 1, wherein during the passive phase the output radiation is deflected into a beam trap.

17. An apparatus for transferring a printing substance from a carrier onto a substrate, the apparatus comprising:

the carrier, wherein the carrier is coated with the printing substance, a time-modulatable laser beam source that comprises an amplifier and has active phases in which the laser beam source is configured to emit laser radiation and passive phases in which no laser radiation is emitted, and an optical deflector configured to deflect the laser radiation, wherein the laser beam source is configured to initiate a transfer process at the start of the active phase during a first time period of a transfer of the printing substance by a temporary increase in the output power above an upper power threshold of the laser radiation, and wherein the laser beam source is configured to adjust, in a second time period in the active phase following the first time period, the output power constantly in the range between the upper power threshold and a lower power threshold.

* * * * *